US005511742A

United States Patent [19]

DeMasters

[11] Patent Number: 5,511,742

[45] Date of Patent: Apr. 30, 1996

[54] APPARATUS AND METHOD FOR PRODUCING A SINGLE COIL OF A DOUBLE RUN PIPE

[75] Inventor: Jimmie G. DeMasters, Wylie, Tex.

[73] Assignee: Phillips Petroleum Company, Bartlesville, Okla.

[21] Appl. No.: 339,430

[22] Filed: Nov. 14, 1994

[51] Int. Cl.[6] ..... B65H 61/00

[52] U.S. Cl. ..... 242/470; 242/388.1; 242/530.2

[58] Field of Search ..... 242/388, 388.1, 242/388.6, 388.7, 470, 530.2, 534, 534.2, 535, 535.1

[56] References Cited

U.S. PATENT DOCUMENTS

| | | | |
|---|---|---|---|
| 2,386,823 | 10/1945 | Thornburgh | 242/530.2 |
| 3,094,833 | 6/1963 | Breffle | 242/470 |
| 3,937,308 | 2/1976 | Sukup | 242/388 |
| 4,148,445 | 4/1979 | Reynolds et al. | 242/388.7 |
| 4,250,130 | 2/1981 | La Spisa et al. | 264/40.7 |
| 4,422,596 | 12/1983 | Cleavenger . | |
| 4,949,909 | 8/1991 | Hatfield . | |

*Primary Examiner*—John P. Darling
*Attorney, Agent, or Firm*—Ryan N. Cross

[57] ABSTRACT

A process and apparatus for simultaneously winding two lengths of plastic pipe onto a single coil is provided, wherein a first length of pipe is extruded and wound onto a first spool, and subsequently a second length of pipe is extruded and wound onto a second spool simultaneously with the first length of pipe from the first spool.

13 Claims, 3 Drawing Sheets

APPARATUS AND METHOD FOR PRODUCING A SINGLE COIL OF A DOUBLE RUN PIPE

BACKGROUND OF THE INVENTION

This invention relates to the coiling of plastic pipe. In one aspect, this invention relates to a method for producing a coil containing two lengths of pipe which can be simultaneously unwound from the coil. In another aspect, this invention relates to an apparatus for simultaneously winding a first length of the pipe and a second length of the pipe into a coil.

For many applications it is necessary to have a loop of pipe typically comprising a first and second run of pipe connected by a u-fitting such that fluid can flow through the first run of pipe, through the u-fitting and into and through the second run of pipe. One such application is geothermal heat exchange.

Typically, geothermal heating and air conditioning systems, i.e., heat pump systems, utilize the ground as a heat source or heat sink. To accomplish this, the geothermal system requires a subterranean heat exchanger which is coupled to a compressor/expander system, i.e., a heat pump. The subterranean heat exchanger comprises a single underground conduit loop or preferably a series of interconnecting underground conduit loops which extend out underground from the heat pump and loop back to the heat pump.

Thus, in a single conduit loop system, as illustrated in FIG. 1, heat exchange fluid circulating through heat pump 2 moves through underground pipe 4, circulates through u-shaped pipe 6, moves up through underground pipe 8 and returns to heat pump 2. Underground pipes 4 and 8, along with u-shaped pipe 6, form the inground conduit system 3. Typically, underground pipes 4 and 8 will be straight, and installed substantially parallel to each other and have a vertical or slanted orientation, preferably a vertical orientation for ease of installation. During the heating cycle, the heat transfer fluid absorbs heat from the earth 12 as it circulates through the inground conduit system 3 and then returns to the heat pump where the heat pump compresses the warm heat transfer fluid to a higher temperature, extracts the heat from it, and distributes the heat extracted through conventional duct systems in the building 10.

During the cooling cycle, heat transfer fluid circulating through inground conduit system 3 ejects heat which is absorbed by the earth 12. The thus cooled heat transfer fluid then returns to heat pump 2 to pick up more heat removed from the building 10.

FIG. 1 illustrates an example of a geothermal heat pump system using a single vertical ground loop for simplicity. However, most systems use more than one vertical loop, usually one loop for each ton of air conditioning capacity is used. The multiple loops are fused in parallel to a header pipe carrying the heat transfer fluid to and from the building. Alternately, systems can be arranged to use a slanted inground conduit system rather than a vertical inground conduit system.

Installation of a conduit loop for an in-ground conduit system comprises drilling a borehole and inserting two runs of pipe into the borehole, with their downhole ends connected by a u-bend fitting, into the borehole. The installation of an inground conduit system such as described above is complicated by the necessity of dealing with two separate coils of pipe for each conduit loop and interconnecting the pipe with a u-bend fitting at the job site. It would, therefore, be advantageous if a double run of pipe was provided in a single pipe coil.

SUMMARY OF THE INVENTION

It is, therefore, an object of this invention to provide an apparatus and method for producing a double run of pipe in a single pipe coil.

The above object is realized in a method for coiling a plastic pipe having a first portion and a second portion, where the method comprises: attaching a first end of the first portion of pipe to a spooler having a first spool; coiling the first portion of the plastic pipe about the first spool; folding the pipe at the second end of the first portion of the plastic pipe to create a folded section; attaching the folded section to a coiler having a second spool; and simultaneously coiling the first portion of pipe and the second portion of pipe about the second spool such that the first portion of pipe is uncoiled from the first spool as it is coiled onto the second spool.

According to another aspect of the invention, there is provided an apparatus for coiling a pipe having a first portion and a second portion comprising: a first spool for receiving the first portion of the pipe, means for coiling the first portion of the pipe about the first spool; counting means for determining when the first portion of the pipe has been coiled onto the first spool; means for folding the pipe after the first portion of the pipe has been spooled onto the first spool so as to create a folded section of the pipe; a second spool for receiving the folded section of the pipe and means for simultaneously coiling the first portion from the first spool and the second portion about said second spool.

BRIEF DESCRIPTION OF THE DRAWINGS

FIG. 4 illustrates the winding of the pipe onto a spooler.

DETAILED DESCRIPTION OF THE INVENTION

Figure 1:
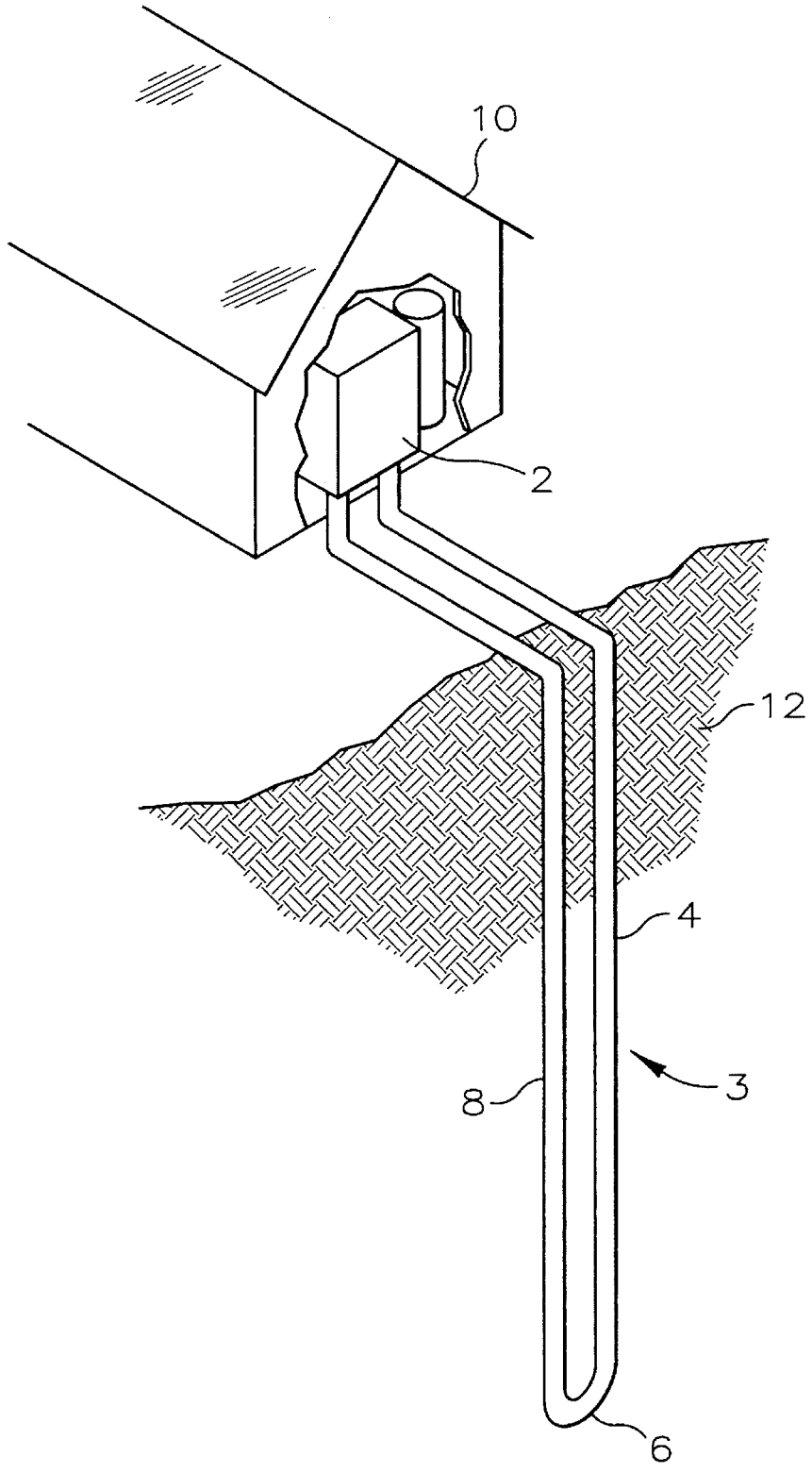
FIG. 1 is a simplified illustration of a geothermal heating and air conditioning system utilizing a vertical inground conduit system.
Figure 2:
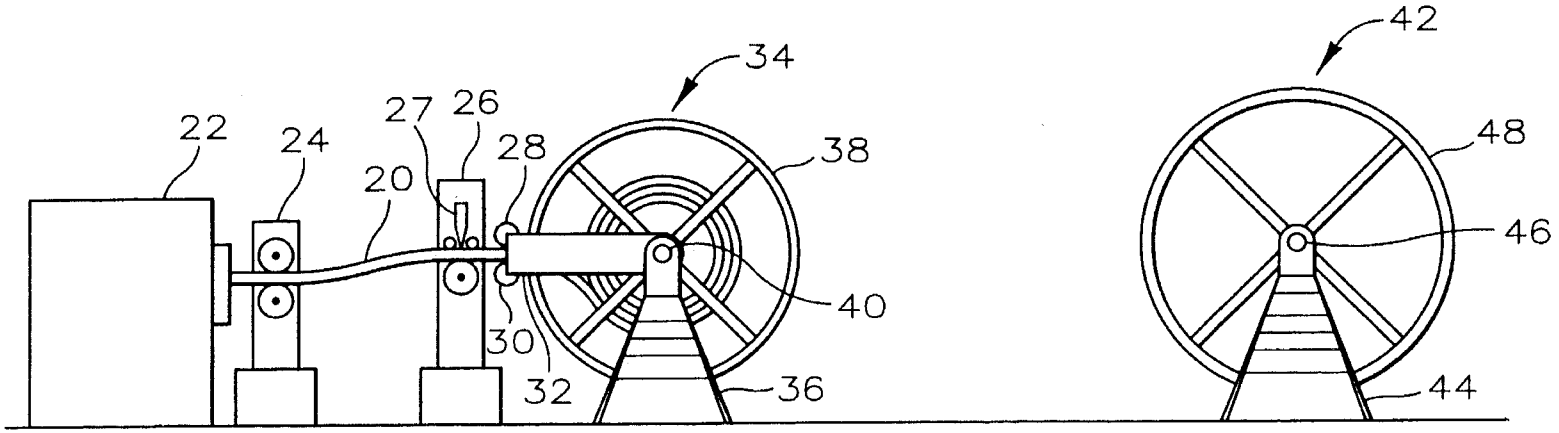
FIG. 2 is a sideview of an apparatus for extruding and winding a double run of plastic pipe according to the invention wherein the figure illustrates the winding of the pipe onto the spooler.

Referring now to FIG. 2, a plastic pipe 20 is shown as it emerges from extruder die 22. From extruder 22, pipe 20 is pulled by pulling means 24 and afterwards enters counter 26 having a cutter 27. After counter 26, the pipe passes between cylinders 28 and 30 which are mounted on dancer arm 32. After passing through cylinders 28 and 30, pipe 20 is wound onto spooler 34.

Spooler 34 has frame means 36, a spool 38 and a motor means 40 adapted to effect rotation of spool 38 whereby the pipe 20 is wound onto spool 38.

Additionally, spooler 34 comprises dancer arm 32 which shares a common rotational axis with spool 38 and can be rotated about the axis by motor means 40. Spool 38 and dancer arm 32 are coupled about the common rotational axis in such a way that motor means 40 can rotate dancer arm 32 independently of spool 38 and similarly, motor means 40 can rotate spool 38 about the common axis independently of dancer arm 32.

Additionally, the apparatus of FIG. 2 comprises coiler means 42. Coiler means 42 has a frame means 44, a motor means 46 and coiler spool 48.

The motor means 40 and 46 can be electric, hydraulic, or pneumatic. The speed of motor means 40 and 46 is controlled by appropriate electrical control means, hydraulic control means or pneumatic control means, respectively, as hereinafter discussed.

In operation, pipe 20 is extruded from extruder 22 and is pulled from extruder 22 by puller 24. The pipe can be extruded by any suitable extruder such as a screw-type, ram-type, or dynamic-type extruder. Pipe 20 is then threaded through cylinders 28 and 30 on dancer arm 32 and then attached to spool 38. While pipe 20 can be threaded through counter 26 prior to being threaded through cylinders 28 and 30, it is preferable that counter 26 be moved into place about pipe 20 after pipe 20 has been threaded through the cylinders 28 and 30. Thus, counter 26 can be automated to move into place by means of an air cylinder or other suitable means and, thus, can be automated to disengage pipe 20 after a suitable length of pipe has been wound onto spool 38. This allows the pipe 20 to bypass the counter when it is being coiled onto coiler spool 48, as shown in FIG. 3.

After the end of pipe 20 is suitably attached to spool 38, the motor means 40 is activated to turn spool 38 and thus wind pipe 20 onto spool 38. During this operation, counter means 26 measures the length of pipe as it is being wound. After a predetermined length of pipe has been wound onto spool 38, cutter 27 of counter 26 cuts partially through pipe 20. Counter 26 is disengaged and motor means 40 is disengaged from spool 38 so that spool 38 ceases turning. Next, motor means 40 engages cylinders 28 and 30 such that the cylinders are moved towards each other to hold pipe 20 in place during the rotation of dancer arm 32. Motor means 40 then rotates dancer arm 32 through from about 90° to about 180° after cylinders 28 and 30 have been engaged to hold the pipe 20. After the rotation of the dancer arm 32 is complete, motor means 40 disengages dancer arm 32 such that it ceases rotation and cylinders 28 and 30 return to their disengaged position. The action of rotating dancer arm 32 creates a folded section of pipe at the point where the pipe 20 was cut by cutter 27.

Figure 3:
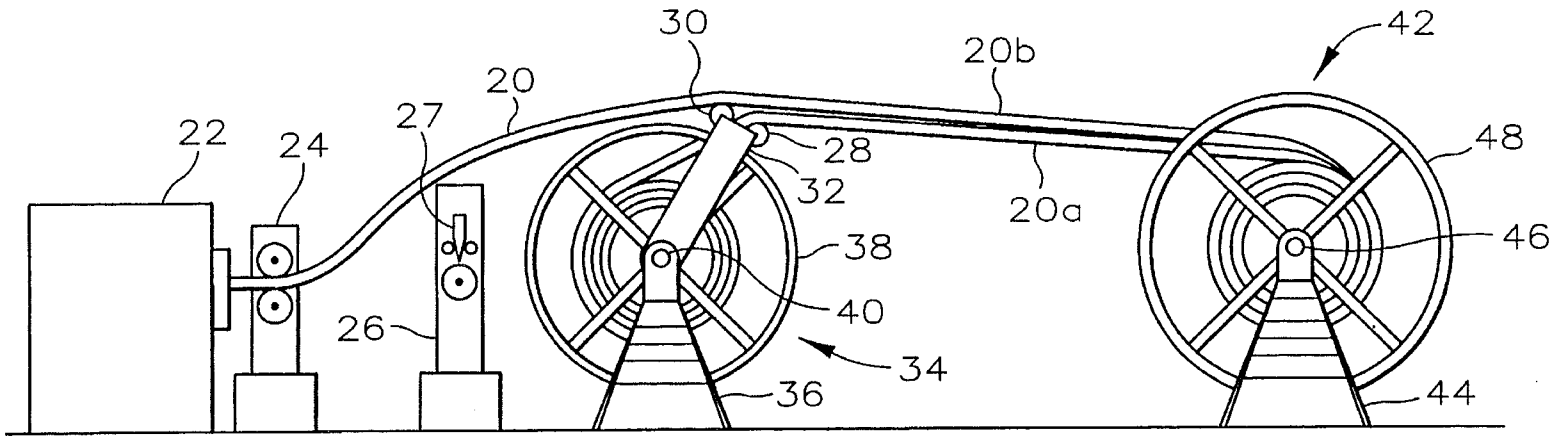
FIG. 3 is a sideview of the embodiment of FIG. 2 wherein the figure illustrates the double run of pipe being wound onto the coiler.

After rotation of the dancer arm 32 has occurred, the folded section of pipe 20 is fed to coiler 42, as can better be seen in FIG. 3. Pipe 20 is attached to coiler spool 48 and motor means 46 is engaged to rotate coiler spool 48 and thus, simultaneously wind pipe **20*a* from spooler 34 and pipe 20*b* from extruder 22 onto coiler spool 48. After all the pipe 20*a* from spooler 34 has been wound upon coiler spool 48, pipe 20*b* is cut so that pipe 20*a* and pipe 20*b*** have substantially equal lengths.

Figure 4:
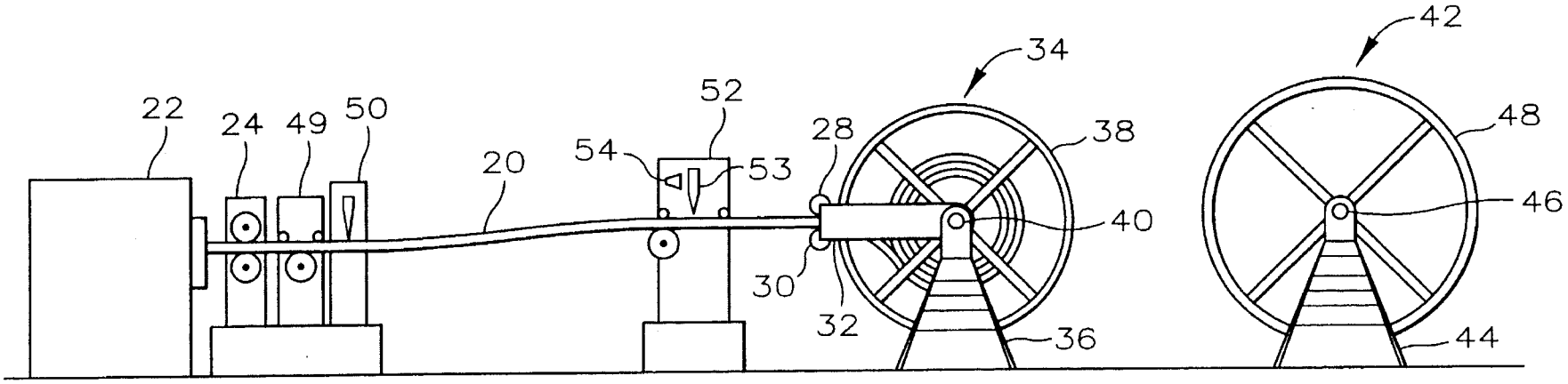
FIG. 4 is a sideview of another embodiment of the apparatus utilizing an extruder, a marker and a sensor for measuring the pipe length.

Turning now to FIG. 4, a different embodiment of the invention is shown. The apparatus of FIG. 4 is similar to the apparatus of FIG. 2; however, the apparatus now includes a measuring means 49, marker means 50 and sensor/cutter means 52. In operation, pipe 20 is extruded from extruder 22 and is pulled from extruder 22 by puller 24. Next, the pipe is threaded through measuring means 49 which, after measuring a predetermined length of pipe, activates marker 50 to mark the pipe. The pipe 20 is threaded through sensor/cutter means 52 where sensor 54 can detect the mark made by marker 50. The pipe is threaded through cylinders 28 and 30 of dancer arm 32 as per FIG. 2 and is wound upon spool 38 of spooler 34. When sensor 54 has detected the mark, spool 38 is stopped from rotating, cutter 53 is activated to cut partially through pipe 20 and motor 40 engages dancer arm 32 as outlined above for FIGS. 2 and 3. After dancer arm 32 has been rotated, the folded section of pipe 20 is threaded onto coiler 42 where pipes **20*a* and 20*b* are simultaneously wound upon spool 48 as described above for FIGS. 2 and 3**.

Figure 5:
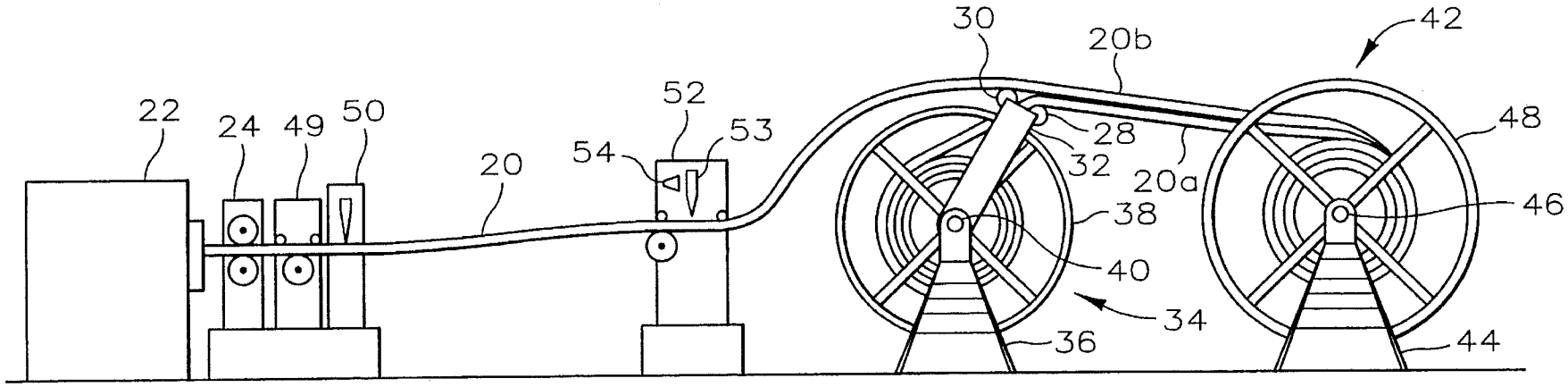
FIG. 5 is a sideview of the embodiment of FIG. 4 wherein the winding of a double run of pipe onto the coiler is illustrated.

Although sensor/cutter means 52 can be disengaged from pipe 20 when dancer arm 32 is rotated, as can be seen from FIG. 5, sensor means 52 can be left engaging pipe 20. Thus, after measuring means 49 measures a second predetermined length of extruded pipe **20*b*, it once again activates marker 50 which in turn marks the pipe. The second mark is then detected by sensor 54 which can activate cutter 53 on sensor/cutter means 52 to cut pipe 20*b* to the predetermined length. Preferably, the lengths of pipe 20*b* and pipe 20*a*** are approximately the same.

Although not illustrated, pipe extruder 22 may be isolated from spooler 34 and coiler 42 by means of a slack segment or by forming the pipe into a closed loop as disclosed in U.S. Pat. No. 4,250,130, which is incorporated herein by reference.

Motor means 40 and 46 can be electric, hydraulic or pneumatic and can have a motor controlling means which can be rheostat or potentiometer, hydraulic valve, or pneumatic valve, respectively. By coupling counter 26 in the embodiment illustrated in FIGS. 2 and 3 to the motor controlling means or by coupling sensor/cutter means 52 in the embodiment illustrated in FIGS. 4 and 5 to the motor controlling means, the motor can automatically disengage spool 38 and engage dancer arm 32 and thus eliminate the need for an operator to manually disengage the motor from spool 38 and engage the motor to dancer arm 32.

The apparatus of this invention is particularly suitable for the high speed extrusion and take-up of small diameter, flexible thermoplastic pipe, such as polyethylene pipe. By small diameter pipe it is meant pipe having an outer diameter of up to about 3 inches. By high speed it is meant an extrusion rate of up to about 500 inches per minute, or greater, generally from about 50 to about 400 inches per minute. For example, a 1-inch pipe can be extruded at speeds up to about 400 inches per minute and 3-inch pipe can be extruded at a rate of about 50 inches per minute.

Reasonable variations and modifications, which will be apparent to those skilled in the art, can be made in this invention without departing from the spirit and scope thereof.

That which is claimed:

1. A method for coiling a plastic pipe having a first portion and a second portion, where the method comprises:

(a) attaching a first end of said first portion of pipe to a spooler having a first spool;

(b) coiling the first portion of said plastic pipe about said first spool;

(c) folding said pipe at the second end of said first portion of said plastic pipe to create a folded section;

(d) attaching said folded section to a coiler having a second spool; and (e) simultaneously coiling said first portion and said second portion about said second spool such that said first portion is uncoiled from said first spool as it is coiled onto said second spool.

2. A process according to claim 1 wherein said first portion and said second portion are substantially the same length.

3. A process for coiling a plastic pipe that is being extruded comprising:

(a) beginning extrusion of a first length of said pipe from an extruder;

(b) attaching a first end of said pipe being extruded to a spooler having a first spool;

(c) coiling said pipe being extruded about said first spool;

(d) extruding said first length and determining when said first length of said pipe has been extruded and coiled about said first spool;

(e) folding said pipe at the second end of said first length of pipe to create a folded section of pipe;

(f) attaching said folded section to a coiler having a second spool;

(g) extruding a second length of said pipe; and (h) coiling said first length of pipe about said second spool and simultaneously coiling said second length of pipe from said extruder about said coiler spool.

4. A process according to claim 3 where in said step (d) comprises:

measuring said pipe as it is extruded to determine when said first length of said pipe has been extruded;

marking said pipe after said first length of pipe has been extruded; and detecting the resulting mark to determine when said first length of said pipe has been coiled about said first spool.

5. A process according to claim 4 further comprising cutting said pipe such that said second length of pipe is substantially equal in length to said first length of pipe.

6. An apparatus for coiling a pipe having a first portion and a second portion comprising:

a first spool for receiving said first portion of said pipe;

means for coiling said first portion of said pipe about said spool;

a counter for determining when said first portion of said pipe has been coiled onto said spool;

means for folding said pipe after said first portion of said pipe has been spooled onto said first spool to create a folded section of said pipe;

a second spool for receiving said folded section of said pipe; and means for simultaneously coiling said first portion from said first spool and said second portion about said second spool.

7. An apparatus according to claim 6 wherein said counter comprises means for measuring said pipe, means for marking said pipe after a predetermined length of pipe has been measured and a sensor for detecting the resultant mark and thus determining when said first portion of said pipe has been coiled onto said first spool.

8. An apparatus according to claim 6 wherein said folding means comprises a dancer arm operationally connected to said first spool for folding said pipe.

9. An apparatus according to claim 6 wherein:

said counter comprises means for measuring said pipe, means for marking said pipe after a predetermined length of pipe has been measured and a sensor for detecting the resultant mark and thus determining when said first portion of said pipe has been coiled onto said first spool; and said folding means comprises a dancer arm operationally connected to said first spool and said sensor such that after said sensor detects said mark, said dancer arm is activated to pivot about said spool so that said pipe is folded.

10. An apparatus comprising:

an extruder for extruding a pipe;

a first spool for receiving a first portion of said pipe and coiling said first portion of said pipe about said first spool;

a counter for determining when said first portion of said pipe has been coiled onto said spool;

means for folding said pipe after said first portion of said pipe has been coiled onto said first spool to create a folded section of said pipe;

a second spool for receiving said folded section of said pipe; and means for simultaneously coiling said first portion of said pipe from said first spool and a second portion of said pipe from said extruder about said second spool.

11. An apparatus according to claim 10 wherein said counter comprises means for measuring said pipe, means for marking said pipe after a predetermined length of pipe has been measured and a sensor for detecting the resultant mark and thus determining when said first portion of said pipe has been coiled onto said first spool.

12. An apparatus according to claim 10 wherein said folding means comprises a dancer arm operationally connected to said first spool for folding said pipe.

13. An apparatus according to claim 10 wherein:

said counter comprises means for measuring said pipe, means for marking said pipe after a predetermined length of pipe has been measured and a sensor for detecting the resultant mark and thus determining when said first portion of said pipe has been coiled onto said first spool; and said folding means comprises a dancer arm operationally connected to said spool and said sensor such that after said sensor detects said mark, said dancer arm is activated to pivot about said first spool so that said pipe is folded.

* * * * *